United States Patent [19]

Surti

[11] Patent Number: 4,965,633

[45] Date of Patent: Oct. 23, 1990

[54] ELECTROPHOTOGRAPHIC COPIER PROCESS KIT HAVING REMOVABLE CLOSURE MEMBERS

[76] Inventor: Tyrone N. Surti, 424 Harding Industrial Dr., Nashville, Tenn. 37211

[21] Appl. No.: 233,448

[22] Filed: Aug. 18, 1988

[51] Int. Cl.[5] ..... G03G 15/00

[52] U.S. Cl. ..... 355/200; 206/455; 355/210; 355/260

[58] Field of Search ..... 355/200, 210, 213, 260, 355/211; 206/455; 354/277

[56] References Cited

U.S. PATENT DOCUMENTS

| | | | |
|---|---|---|---|
| 4,150,896 | 4/1979 | Wakeman | 355/75 |
| 4,470,689 | 9/1984 | Nomura et al. | 355/228 X |
| 4,607,941 | 8/1986 | Honda | 355/210 |
| 4,609,276 | 9/1986 | Mitzutani | 355/210 |
| 4,708,455 | 11/1987 | Kubota et al. | 355/211 |
| 4,780,357 | 10/1988 | Akao | 206/455 X |

FOREIGN PATENT DOCUMENTS 207899 3/1987 Japan .

*Primary Examiner*—A. T. Grimley
*Assistant Examiner*—Thu A. Dang
*Attorney, Agent, or Firm*—Phillips & Beumer

[57] ABSTRACT

A process kit for use in an image-forming apparatus. The process kit includes a development device, a corona discharger, and a cleaning device disposed in spaced relation around the periphery of a photosensitive drum. Each of the above-mentioned components, including the drum, are releasably mounted in a primary housing which is disposed for insertion into the image-forming apparatus. A bracket is disposed at the opposite ends of the development device, corona discharger, cleaning device, and photosensitive drum to releasably secure these components in the primary housing in a manner which provides access thereto for refurbishment or replacement thereof. A removable cover is removably mounted over openings provided in the housing.

10 Claims, 7 Drawing Sheets

ELECTROPHOTOGRAPHIC COPIER PROCESS KIT HAVING REMOVABLE CLOSURE MEMBERS

FIELD OF THE INVENTION

This invention relates generally to process kits for image-forming devices and more particularly to such process kits having process means for acting on an image-bearing member to perform an image-forming process.

BACKGROUND OF THE INVENTION

Electrophotographic copying apparatus typically includes a photosensitive member, such as a drum, as an image bearing member, a corona discharge member, a developer including a toner, and a cleaning device for cleaning residual toner left on the drum and for storing the removed toner. The corona discharge member, developer, and cleaner are disposed in spaced relation around the periphery of the drum. After a period of use, servicing of various parts are required. In the past, such servicing required a serviceman to go to the user's office to interchange, adjust, or clean these various components.

Recently, however, in order to eleminate the requirement for a serviceman, kits have been constructed in which the photosensitive drum, the developing device, cleaning device, and corona discharger have been made into a unitary structure. Such unitary structures are disclosed in U.S. Pat. Nos. 3,985,466; 4,575,221; and 3,385,436. These unitary structures are provided so that the need for a serviceman is eliminated.

Such processing kits also typically include a housing having a pair os spaced openings at the top and a single opening at the bottom thereof. The upper openings comprise an optical opening located upstream of the corona discharge member for conducting a uniform light to the photosensitive drum to discharge any remaining charge on the drum, and an opening for exposure is located between the corona discharge member and the development device for conducting information light to the photosensitive drum. The lower opening exposes the drum to a transfer mechanism which transfers the latent image from the drum to a sheet of paper or the like.

Additionally, the optical opening, the opening for exposure, and the lower opening are provided with pivotally mounted covers which are provided with springs for biasing thereof between open and closed positions. Also, since these covers must be removed from over the openings for use in the copying apparatus, the copying apparatus is generally provided with actuating mechanisms for pivoting the covers away from the openings so that the openings are unobstructed once the kits are inserted.

Further, the structure of each of the above process kits requires that it be thrown away if any one of the components are expended. That is, for example, if the toner in the developing device has been depleted, it is required that the toner and all other internal components of the developing device (which includes a cylindrical development sleeve, a magnetic roller, and a magnetic blade) be thrown away. In addition to discarding the complete development device, it is necessary to discard the photosensitive drum, the complete cleaning device (with wiper blade, etc.), the corona discharger and mounting assemblies, and the housing with all of its appurtenances, such as alignment pins, electrical connectors, and counting mechanism, etc. Obviously, such complete replacement of parts is not only unnecessary but also undesirable from a cost standpoint.

Applicant provides a structure wherein any of the abovementioned processing components may be individually serviced or replaced, thus eliminating the need for purchasing unneeded parts. Additionally, applicant has provided such a structure in which the internal components are made readily accessible for facile servicing or replacement of individual components by an operator, thus eliminating the delays and expenses incurred when relying on a serviceman.

Applicant also provides a process kit which eliminates the need for pivotally mounted doors, spring biasing means, and an actuating mechanism for pivotally opening the doors responsive to insertion of the process kit in the copying apparatus.

It is, therefore, an object of the present invention to provide a process kit for an electrophotographic image-forming apparatus in which any single component of various process means may be serviced or replaced in an inexpensive an facile manner without requiring the service of a serviceman.

It is a further object of the present invention to provide a cover for openings in the process kit, such cover being removable so as to eliminate the need for biasing means and internal structures of the copying machine for actuating the biasing means.

DESCRIPTION OF THE PREFERRED EMBODIMENT

Figure 1:
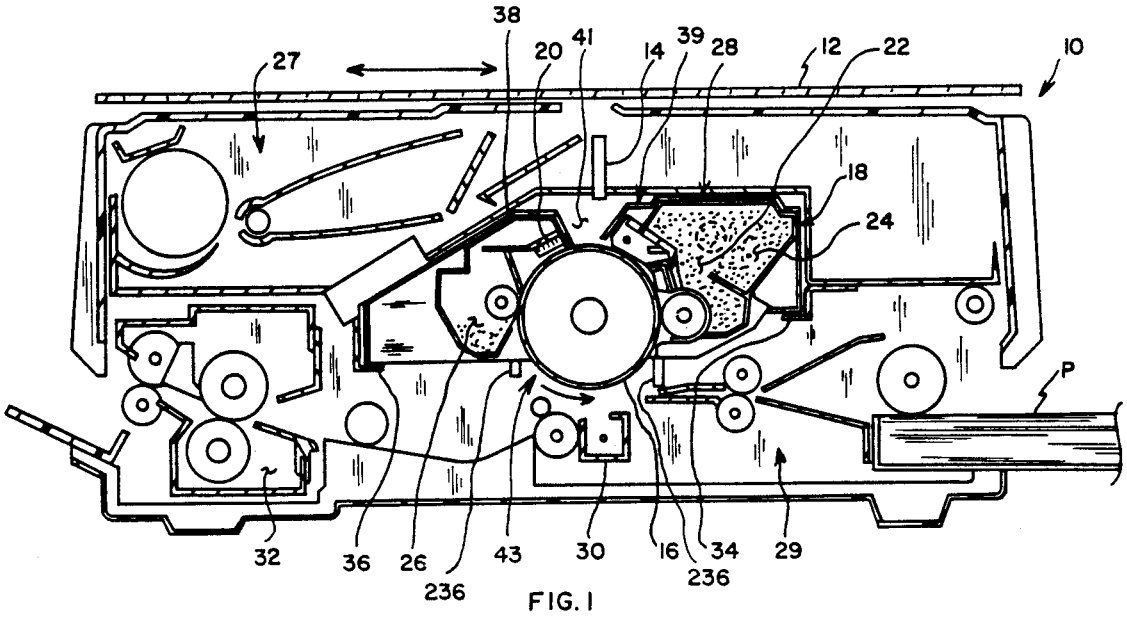
FIG. 1 is a cross-sectional view of a copying machine in which a process kit of the present invention is mounted.

As seen in FIG. 1, an electrophotographic copying machine 10 comprises a transparent table 12 movable in directions indicated by the arrow. An original which is to be reproduced is placed on table 12. Typically, an array of image-forming elements 14 is arranged to expose an image of the original document to a photosensitive drum 16 which is rotatable in the direction shown by the arrow. As is well known, the drum typically includes a photosensitive OPC layer and an electrically conductive substrate. An assembly or unit 18, known in the art as a process kit, is releasably mounted in the copying machine. The process kit 18 includes a corona discharger 20 for uniformly charging the photosensitive drum 16, a development device 22 having a toner 24 therein for developing an electrostatic latent image which has been formed on the drum through optical array 14. A cleaning device 26 is also mounted in a housing 28 of process kit 18 and spaced from development device 22 around the periphery of photosensitive drum 16. A counter 31 is secured to an end of housing 18.

Machine 10 includes upper and lower assemblies 27 and 29, and lower assembly 29 includes various rollers and other assemblies which cooperate in moving a transfer sheet P past drum 16 for fixing the toner image on the sheet in a manner well known in the art. As is also known, as the drum rotates, a toner is placed thereon; and when sheet P reaches the drum, the toner image is transferred from the drum to sheet P by a transfer charger 30 carried in machine 10. The sheet is then moved through a fixer 32 also mounted in machine 10 where the toner image is fixed to sheet P. Some toner remains on the drum, and this remaining toner is collected and stored in cleaning device 26.

Figure 6:
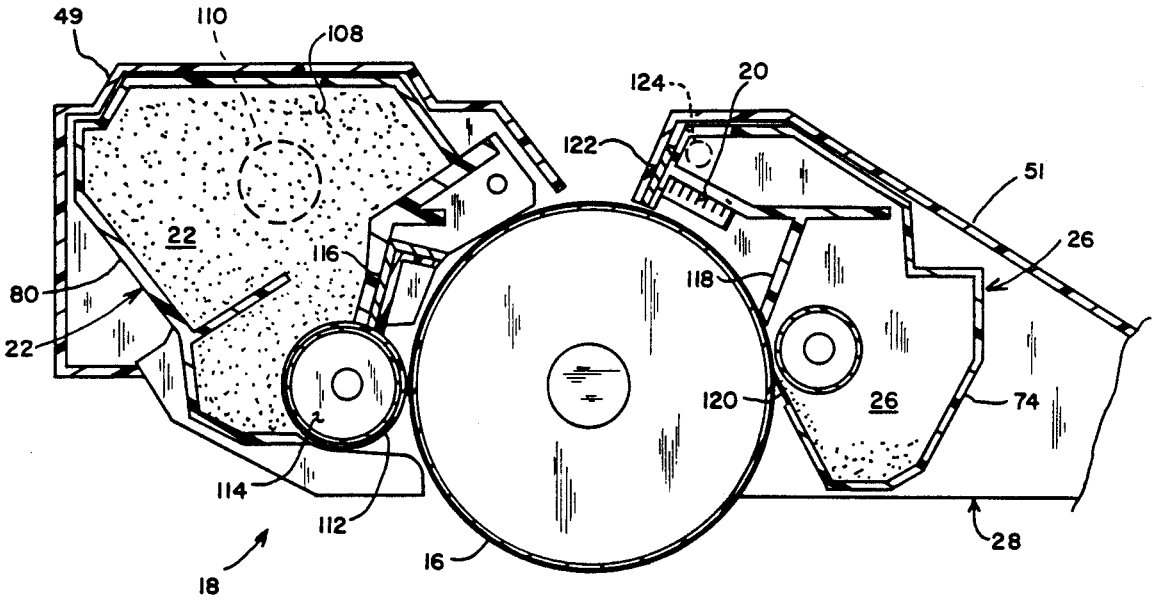
FIG. 6 is an enlarged sectional view taken along line 6—6 of FIG. 2 illustrating the positions of the developing device, cleaning device, corona discharger, and drum.

As can be seen in FIGS. 1 and 6, housing 28 encloses the development device 22, corona discharger 20, and cleaning device 26 around drum 16 and also forms a light shielding wall that is separate from the upper and lower housings of machine 10. The process kit is releasably mounted in machine 10 along rails 34 and 36 located in machine 10.

An optical opening 38 is provided on the upper surface 39 of the housing, and an opening 41 for exposure is also provided on the upper surface of the housing. Optical opening 38 is located upstream of the corona discharge device for conducting uniform light to the photosensitive drum to discharge any remaining charge thereon, and the opening for exposure is located between the corona discharge device and the development device for conducting information light to the photosensitive drum. A bottom opening 43 is provided in the bottom of housing 28 to expose the bottom of the drum at a trasfer station to transfer the image to paper or the like. Such structure is well known in the art.

If an operator desires to remove the process kit, the upper housing of machine 10 is swung upwardly to an open position. Process kit 18 is then moved along rails 34 and 36 along the axis of drum 16.

Figure 2:
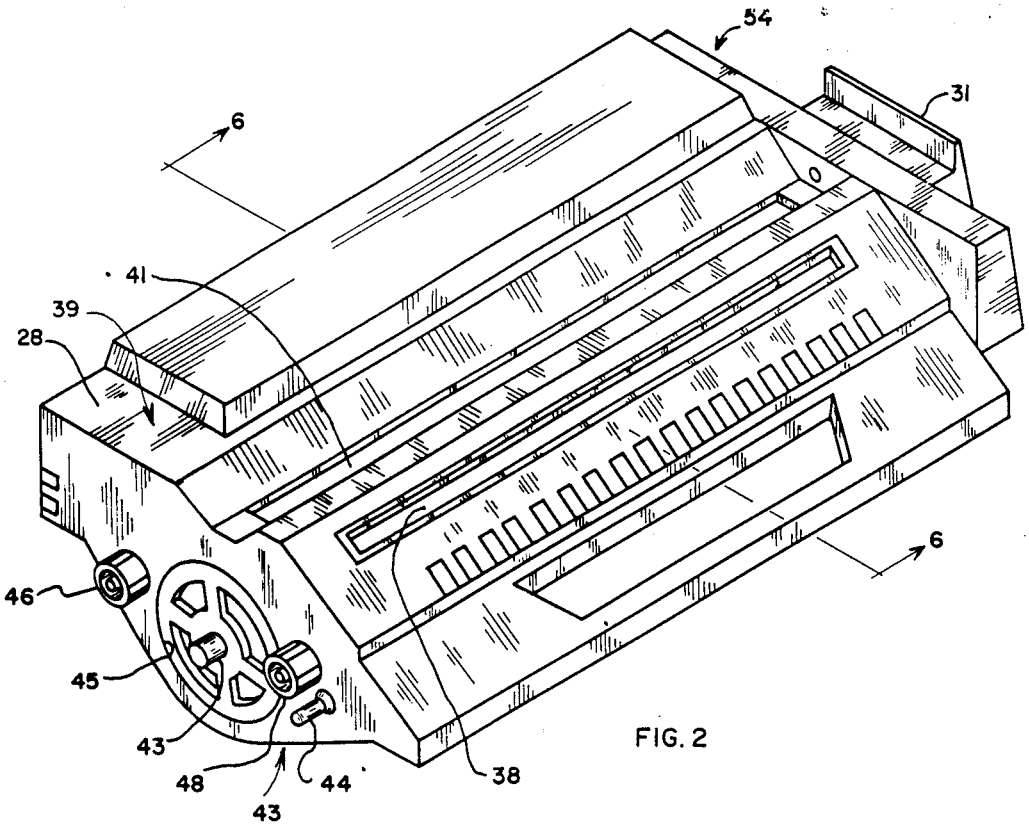
FIG. 2 is a pictorial view of a process kit housing in with the covers for the optical opening and opening for exposure removed.

As shown in FIG. 2, housing 28 of process kit 18 is provided with a pin 44 for properly positioning the process kit in the machine, an electrical connector 46 for supplying charger 20 with a high voltage, and a connector 48 for applying a bias voltage to development device 22. Additional positioning means may be provided between the machine and the housing wall opposite the wall on which pin 44 is provided. A driving connection assembly 43 extends through an opening 45 in housing 28.

Figure 3:
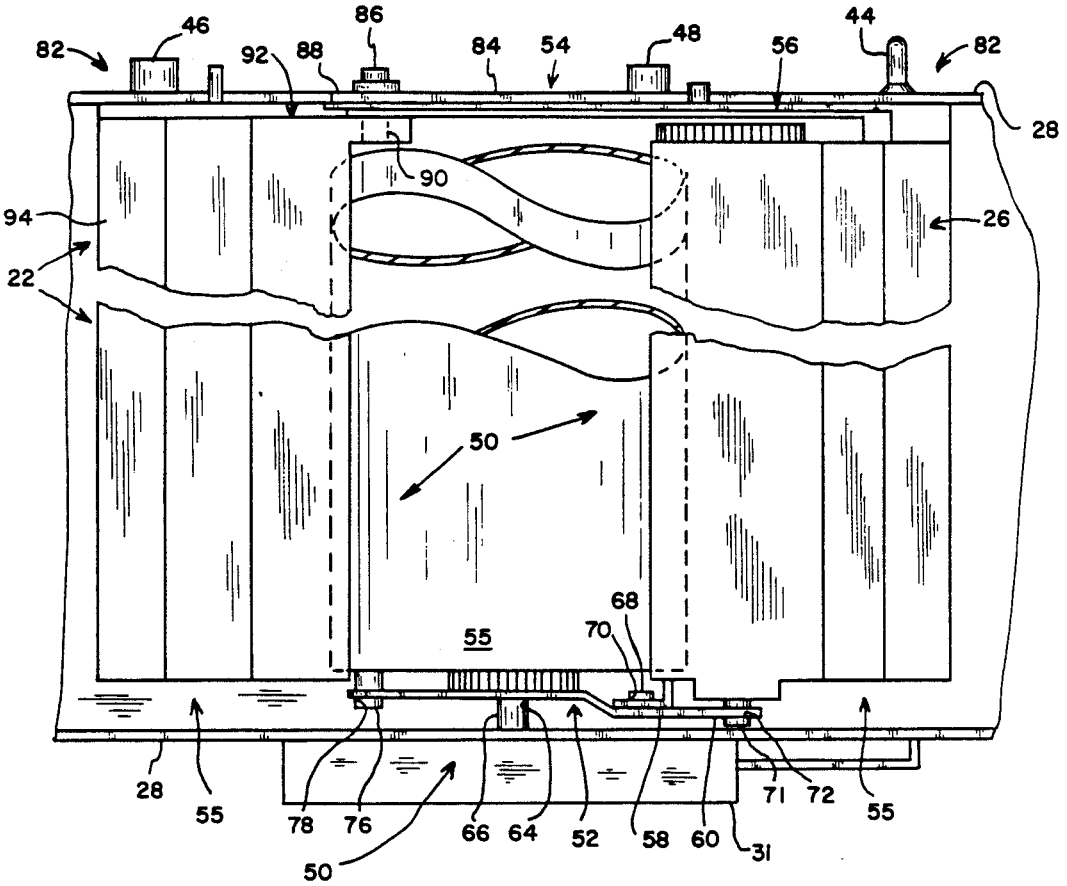
FIG. 3 is a partial inverted plan view of the photosensitive drum and support structure for pivotally mounting the developing device and the cleaning device on opposite sides of the drum in the process kit housing of FIG. 2. The view illustrates the underside of the assembly as mounted in the machine of FIG. 1.
Figure 4:
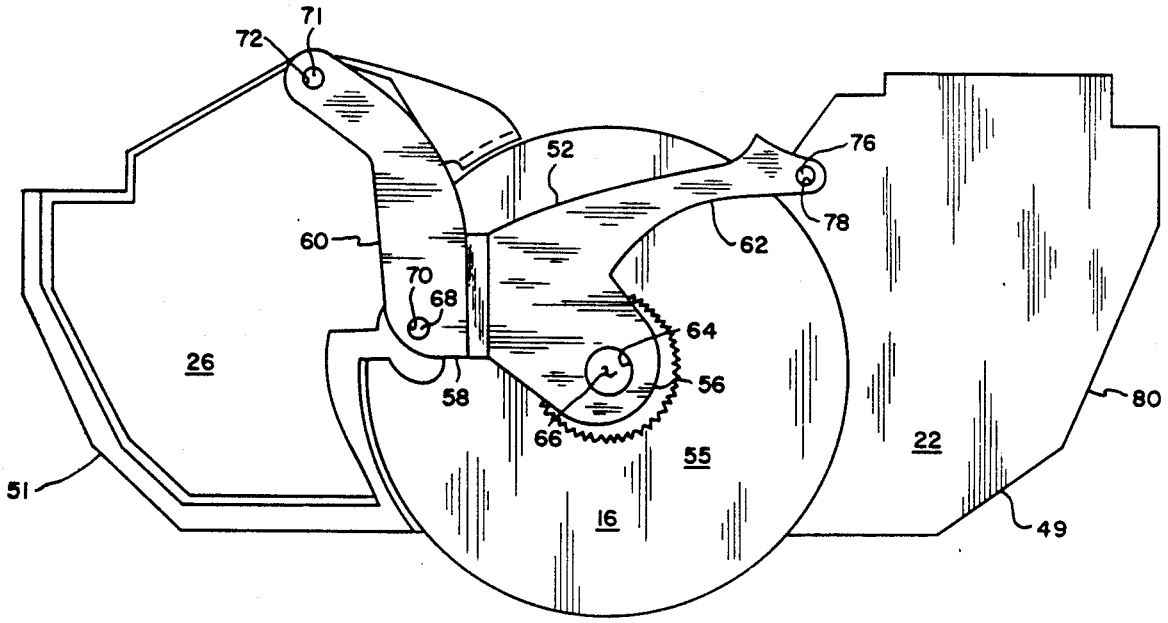
FIG. 4 is a rearward end elevational view (not inverted) illustrating the pivotal support means for the drum, the developing device, and the cleaning device of the present invention.

To provide for access into the process kit for servicing thereof by refurbishment or replacement of the internal components, including the development device 22, cleaning device 26, drum 16, and corona discharge 20, an inner housing assembly 50 is provided and includes a housing 49 of development device 22, a housing 51 of cleaning device 26, and a pair of end support members or brackets 52 and 54 (FIG. 3). Members 52 and 54 are disposed for removably supporting development device 22, cleaning device 26, and drum 16 in housing 28. Bracket 52 (FIGS. 3 and 4) is disposed at the forward end 55 of housing assembly 28, and, as seen in FIG. 4, includes four legs 56, 58, 60, and 62. Leg 56 includes an opening 64 positioned around a stub shaft 66 of drum 16. Legs 58 and 60 include a pair of pins 68 and 70 which releasably extend into openings 70 and 72, respectively, of housing 51 of cleaning device 26. Leg 62 is provided with a pin 76 which extends into an opening 78 of housing 49 of development device 22. Housing 49 of development device 22 is pivotally supported by pin 76.

Figure 5:
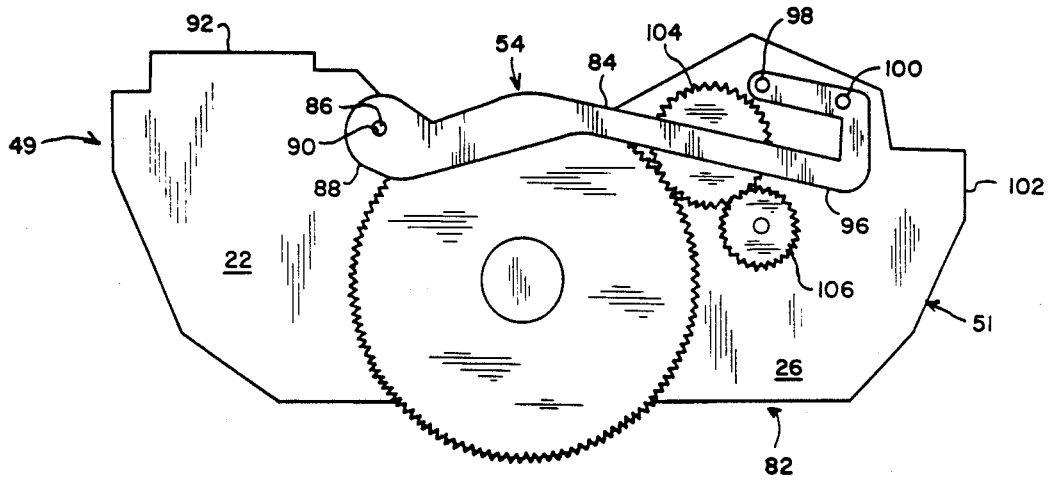
FIG. 5 is a forward end elevational view similar to FIG. 4 of the pivotal support means for the drum, the developing device, and the cleaning device of the present invention.

As can be seen in FIGS. 3 and 5, bracket 54 is disposed at the rearward end 82 of housing 28 and includes an arm 84 having a pin 86 disposed at one end 88 thereof. Pin 86 extends into an opening 90 provided in the rearward end 92 of housing 49 of development device 22. Housing 49 is pivotally mounted by pin 86. The second end 96 of arm 84 is rigidly secured by a pair of pins 98 and 100 (FIG. 5) to the rearward end 102 of housing 51. Arm 84 passes a pair of gears 104 and 106 which rotate a wiper arm in cleaning device 26 for cleaning residual toner on the drum, in a manner known in the art.

FIG. 6 illustrates the positioning of the corona discharger 20 relative to drum 16. As seen in FIG. 6, the development device 22 includes housing 49, a toner 108, and a plug 110 for retaining the toner in housing 49 of the developing device 22. Developing device 22 is shown to include a development sleeve 112 of non-magnetic material enclosing a magnetic roller 114. A magnetic blade 116 is also mounted in housing 49.

As also seen in FIG. 6, cleaning device 26 includes housing 51, a scraper blade 118, a scooping sheet 120, and a magnet 122. A plug 124 is provided for removal of the used toner from housing 51, if desired. Both the cleaning device and development devices are well known in the art; however, as seen in FIG. 6, corona discharge 20 is located in this housing 51 adjacent the drum 16. The corona discharger is removably mounted in the housing to permit cleaning or replacement thereof.

Figure 7:
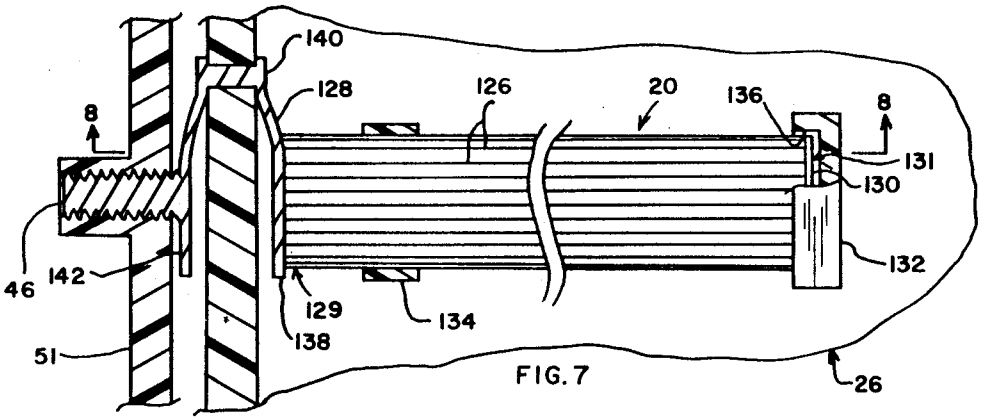
FIG. 7 is a partial plan view illustrating the manner in which the corona assembly is mounted in its housing.
Figure 8:
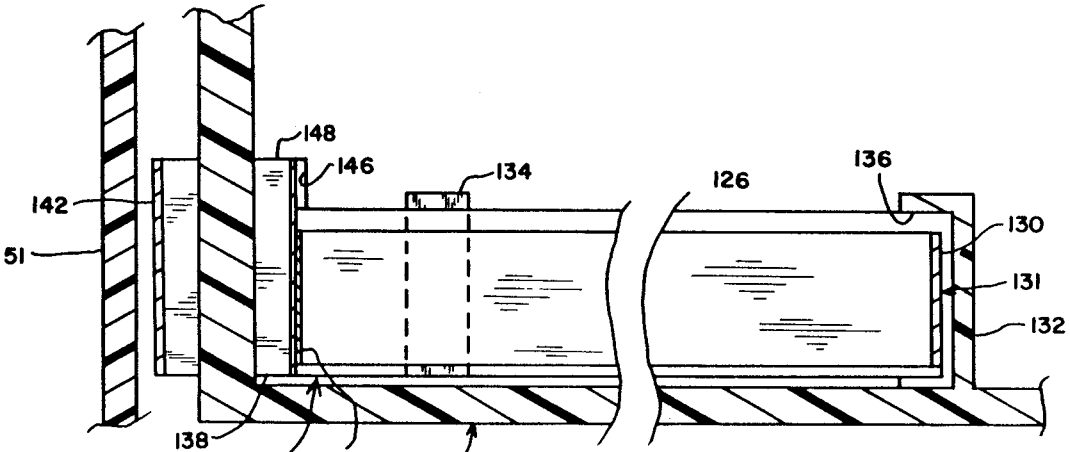
FIG. 8 is a sectional view taken along line 8—8 of FIG. 7.

FIGS. 7 and 8 illustrate a manner in which the corona discharger may be removably mounted in housing 51 to provide electrical contact with the printing machine's electrical connector. As seen in FIG. 7, corona 20 includes a plurality of substantially parallel conductors 126 connected to a pair of end conductive members 128 and 130. Corona 20 is positioned in a pair of brackets 132 and 134 molded in housing 51. Bracket 132 is provided with an opening 136 into which the end 131 of corona 20 is inserted and held. Bracket 134 maintains the proper alignment of the corona in housing 51 adjacent the forward end 129 of corona 20. To provide electrical contact with the electrical contact of the main machine, a first electrical resilient contact member 138 is secured in housing 51 by a conductive pin 140 and is disposed for engagement with end 129 of corona 20. Pin 140 extends through housing 51 and secures a second electrical resilient contact 142 thereto. Contact 142 is disposed for electrical contact with conductive screw 46 which is secured in housing 51 for electrical contact with the electrical source in the printer. To retain corona 20 in secured relation in brackets 132 and 134, conductor 138 may be provided with a protrusion 146 along its upper surface 148 for gripped engagement with an upper surface 150 of end member 128 of corona 20 (FIG. 8).

Similar electrical leaf spring connections between development device 22 and electrical contact 46 of housing 28 may be provided to effect the necessary electrical connections between the printer and the development device.

Figure 9:
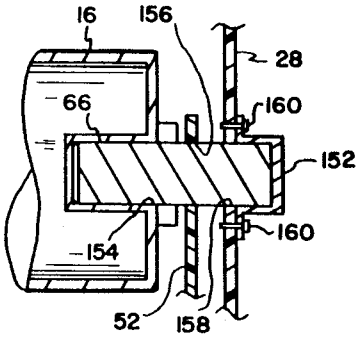
FIG. 9 is partial sectional view illustrating a manner in which the stub shaft for the rotatable drum may be arranged. The bracket assembly of the internal housing has been removed for clarity.

As seen in FIG. 9, stub shaft 66 of drum 16 may be secured in the assembly by an end cap 152 which secures the shaft in an opening 154 of drum 16 and in openings 156 and 158 of bracket 52 and housing 28. Cap 152 is secured to housing 28 by screws 160.

Figure 11:
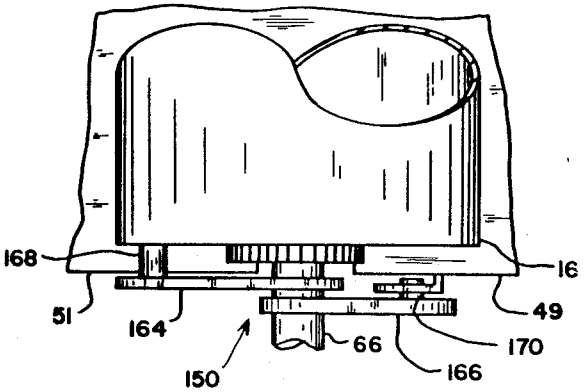
FIG. 11 is an elevational view taken along line 11—11 of FIG. 10.
Figure 12:
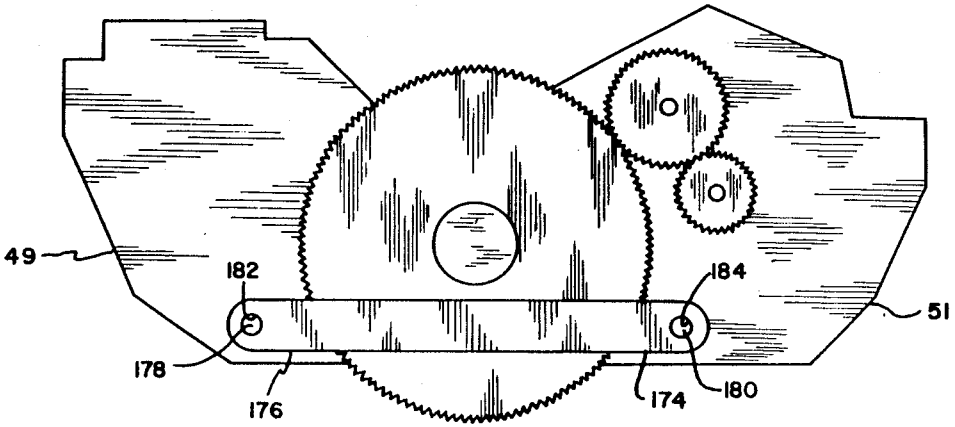
FIG. 12 is a view similar to FIG. 10 of another bracket which may be used at the rear end of the process kit assembly.
Figure 10:
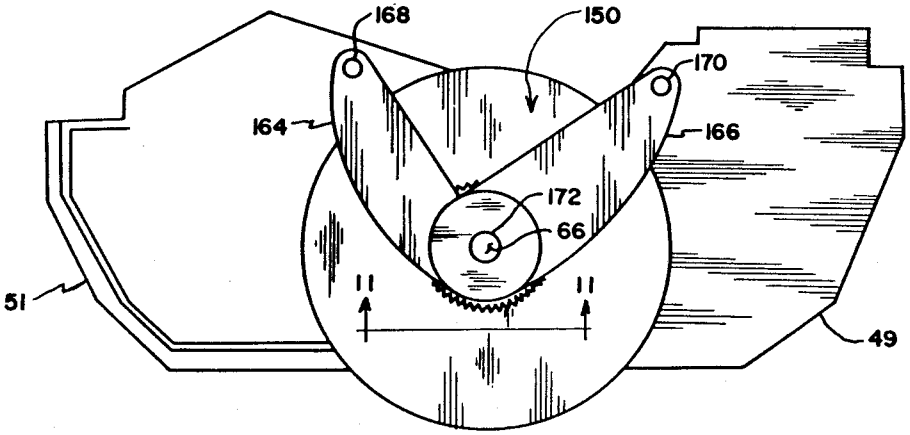
FIG. 10 is an elevational view illustrating another type of bracket which may be used at the forward end of the process kit assembly for pivotal movement of the developing device housing and the cleaning device and corona assembly housing.

FIGS. 10–12 illustrate other types of brackets which may be used in lieu of brackets 52 and 54, previously disclosed. As seen in FIGS. 10 and 11, a bracket 150 may be used instead of bracket 52. Bracket 150 is shown to include a pair of legs 164 and 166 which are, respectively, releasably and pivotally secured to housingS 49 and 51 by pins 168 and 170. An openings 172 is provided in the bracket for pivotally securing the bracket to shaft 66 of drum 16.

FIG. 12 illustrates a bracket 174 which may be used in lieu of bracket 54 and includes an arm 176 extending between housing 49 of developing device 22 and housing 51 of cleaning device 26. Arm 176 is provided with a pins 178 and 180 which are releasably inserted in openings 182 and 184 of housings 49 and 51.

Once the process kit is inserted in the printer, proper alignment is maintained by pin 44 (FIG. 2), and electrical contact is made through contacts 46 and 48. Also, driving connection to drum is made through driving connection assembly 43 which extends through an opening 45 in housing 28. It is to be understood that while the corona assembly has been described as being mounted in cleaning device housing 51, it may be mounted in outer housing 28 or in a separate housing altogether. However, in accordance with the principles of the present invention, it is desirable that the corona assembly be releasably mounted.

FIGS. 14–20 illustrate various types of removable closure members which may be used in covering openings 38 and 41 prior to insertion of the process kit in the image forming apparatus.

Figure 13:
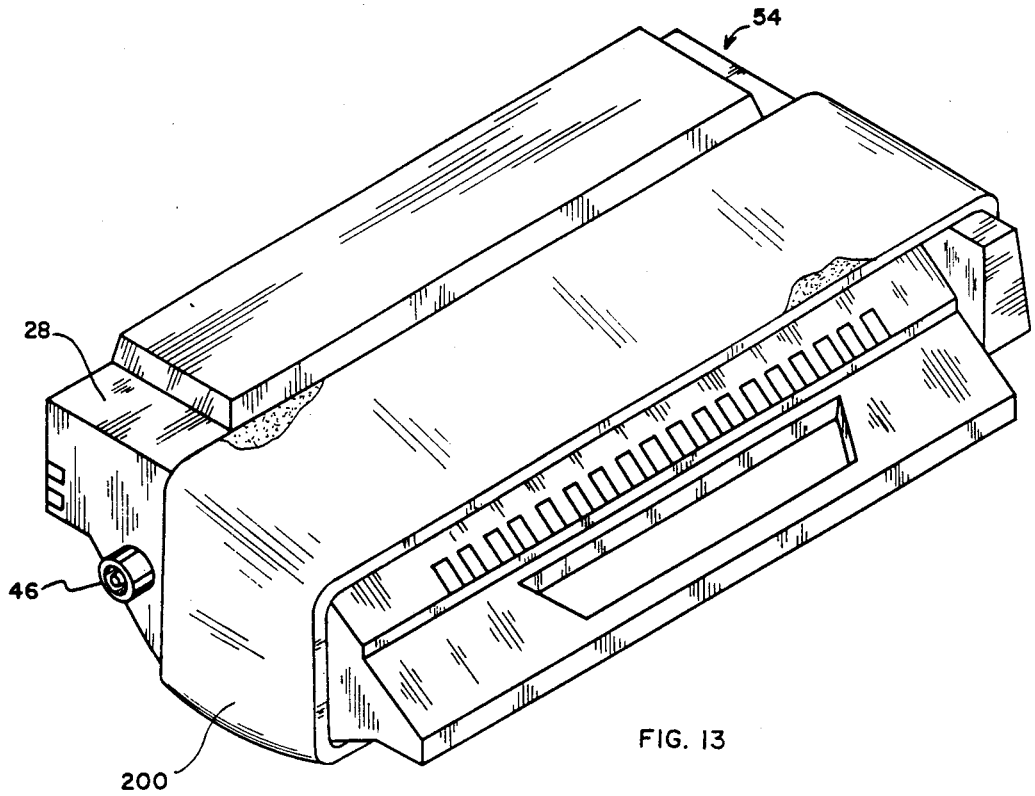
FIG. 13 is a pictorial view of the process kit of FIG. 1, with a flexible, continuous, removable cover of the present invention installed.
Figure 14:
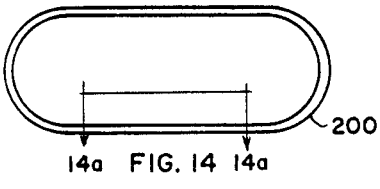
FIG. 14 is a side elevational view of the removable cover of FIG. 13.
Figure 14A:
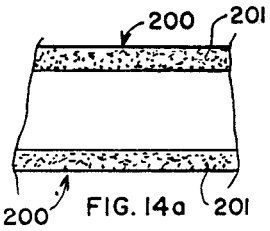
FIG. 14*a* is an elevational view taken along line 14*a*—14*a* of FIG. 14 showing Velcro TM strips along the edges of the cover member.

As seen in FIGS. 13, 14, and 14*a*, cover 200 in the form of a continuous band is utilized as the removable cover. The band is made of stretchable material so that it may snugly enclose housing 28. As seen in FIG. 14*a*, Velcro TM strips 201 may be placed along the edges of the cover and on the upper and lower surfaces of the housing along the sides and ends (if desired) of the openings to secure the cover to the surfaces and thus assure that, when not in use, no light enters the openings.

Figure 15:
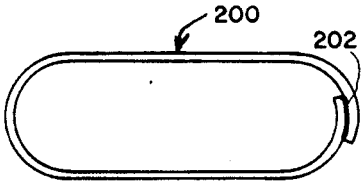
FIG. 15 is a pictorial view of another embodiment of the removable cover of the present invention illustrating a discontinuous cover having Velcro TM fasteners at the end thereof.

FIG. 15 illustrates a discontinuous type of removable closure member 200 provided with Velcor TM 202 at the ends thereof to fasten the cover around housing 28. The material may be stretchable or non-stretchable. Velcro TM strips may be placed along the edges of this cover member in the manner described, if desired.

Figure 16:
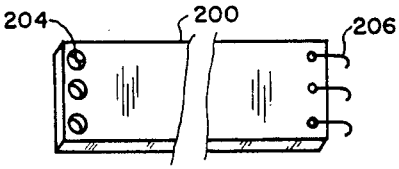
FIG. 16 is a view illustrating a hook and eyelet type of fastening device fastening the ends of the cover about a cartridge housing.

FIG. 16 illustrates a removable cover member 200 in the form of a band with eyelets 204 and hooks 206 at the ends thereof to fasten cover around housing 28. Preferably, the band is made of a stretchable material.

Figure 17:
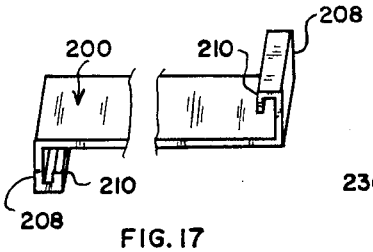
FIG. 17 is a view similar to FIG. 16 illustrating another type of fastening device of the present invention.

FIG. 17 is a pictorial view of a band cover member having member 208 secured to the ends thereof. Members 208 are provided with extending bent interlocking sections 210 which engage and interlock to secure the band around housing 28. The band is made of a stretchable material.

Figure 18:
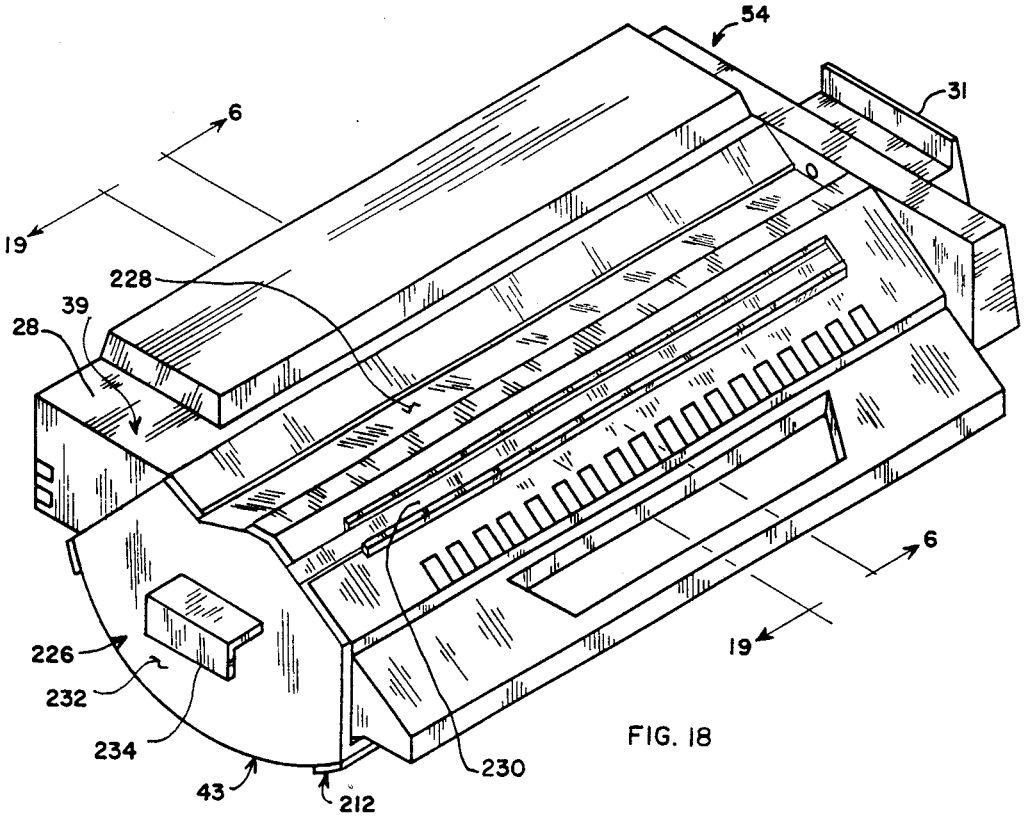
FIG. 18 is a view similar to FIG. 13 illustrating a unitary, rigid, removable cover for the housing.
Figure 19:
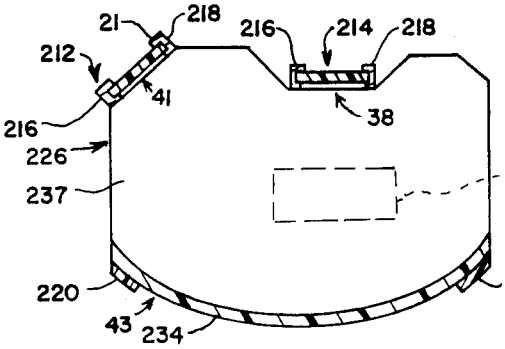
FIG. 19 is a sectional view of the cover as seen along line 19—19 of FIG. 13, with internal portions of the process kit removed for clarity.

FIGS. 18 and 19 illustrate yet another embodiment of the removable closure member of the present invention. In this embodiment, the upper surface 39 of housing 28 is provided with guides 212 and 214 which are disposed on opposite sides of upper openings 38 and 41. The guides are provided with raised side portion 216 and 218 which run along opposite sides of openings 38 and 41. The bottom opening 43 is similarly provided with such guides 220 and 222. The cover includes a unitary member 226 having upper extending finger portions 228 and 230 extending from an end portion 232. A lower arcuate portion 234 extends from end portion 232. A gripping member or handle 234 extends from end portion 232 for gripped engagement by an individual to remove the cover from the housing just prior to insertion of the housing into the image forming machine. The cover of this embodiment is rigid and may be plastic or the like. All of the above covers described herein, of course, must be capable of preventing light from entering the housing.

Figure 20:
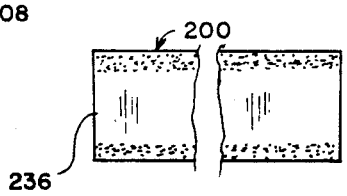
FIG. 20 is a plan view from the underside of a light shielding strip having an adhering surface along the edges thereof.

If desired, individual strips 236 of light shielding tape having an adhesive surface may be placed over the openings (FIG. 20). The surface may be similar to adhesive tape or Velcro TM strips 238 in which Velcro TM must also be provided on the adhering surfaces of the kit housing. All of the non-rigid cover members may be made of woven flexible fabric, rubber, plastic, felt, or a sponge-like flexible material, or any combination of such materials, it only being necessary that the material used next to the drum will not harm the surface of the drum by scratching, etc.

It should be further understood that portions of the cover may be formed with cut-outs to permit any projections or appurtenances of the process kit housing to extend through the cover, such as projecting members 43, 44, 46, and 48 of FIG. 2.

To provide protection to the drum, standoff supports 236 may be mounted on the bottom of the housing adjacent to the ends of the drum. Preferably, four supports 236 may be used, with two supports being positioned on the same side of the housing.

Alternately, ridges may be provided which extend substantially along the length of the drum on the bottom surface of the housing, or, if desired, members may be provided at the ends of the drum which project outwardly from the bottom of the housing beyond the outer surface of the drum. Such structure provides protection for the drum should the drum be laid on a surface, such as a desk, etc.

It should be understood that while the removable cover of the present invention has been discussed in conjunction with a process kit having removable or refurbishable components, this is not to be taken in a limiting sense since the covers may be used in any type of housing having openings therein to receive light therethrough, such as that disclosed in U.S. Pat. No. 4,575,221. It is to be further understood that the cover may be used in process kits that are mounted in the printing apparatus perpendicularly to the driving or rotational axis of the drum, as well as parallel to the rotational axis.

It should be obvious from the foregoing that applicant has provided a removable cover for use in process kits for electrophotographic copies which eliminates the need for springs to bias doors into opening and closing positions and which also eleminates the need for pivotal mounting structure for such doors. Additionally, the need for complicated, cumbersome actuating structure provided in the image forming apparatus is eleminated. Such actuating structure is expensive to manufacture and install in the image forming apparatus.

I claim:

1. A process kit for insertion and use in an image-forming apparatus comprising:

a housing;

a photosensitive drum rotatably mounted in said housing;

processing means including a plurality of components mounted in said housing in spaced relation around said photosensitive drum, said components including at least a corona discharge means for uniformly charging said photosensitive drum to a predetermined potential, development means for developing an electrostatic latent image formed on the photosentive drum, and a cleaning device for cleaning said photosensitive drum subsequent to formation of said electrostatic latent image thereon, said cleaning device being in peripheral spaced relation around said photosensitive drum from said development means;

said housing including a first optical opening located upstream of said corona discharge means for conducting a uniform light to said photosensitive drum to discharge remaining charge on said photosensitive drum, a second opening for exposure located between said corona discharge means and said development means for conducting said information light to said photosensitive drum, a third opening disposed at a position generally opposite said first and second openings, and guide means disposed adjacent to said first, second, and third openings; and removable cover means removably carried by said housing, said removable cover means being a rigid unitary member having extending fingers disposed for slidable relation in said guide means for removably mounting said removable cover means over said first, second, and third openings for enclosing said first, second, and third openings prior to insertion of said process kit in said image forming apparatus, said removable cover means disposed for complete removal from said first, second, and third openings for unobstructed relation of said first, second, and third openings in said image forming apparatus subsequent to insertion of said process kit in said image forming apparatus.

2. Apparatus as set forth in claim 1 wherein said extending finger members are joined at one end thereof to a single end member having an extending handle portion.

3. Apparatus as set forth in claim 2 including support means carried in said housing for pivotally supporting a pair of said components relative to said drum to provide access to predetermined said processing components for refurbishment or replacement thereof.

4. Apparatus as set forth in claim 3 wherein said development device is provided with a first housing, and said cleaning device is provided with a second housing, and said support means includes a first support means disposed for relative pivotal support of said first and second housing at a first end thereof and a second support means disposed for relative pivotal support of said first and second housing at a second end thereof.

5. Apparatus as set forth in claim 4 wherein said drum is provided with first and second shafts, each disposed at opposite ends thereof, and data first support means is comprised of a member having a first portion thereof secured to said cleaning device housing, a second portion pivotally secured to said development device housing, and a third portion secured to said first shaft of said drum.

6. Apparatus as set forth in claim 5 wherein said second support means is comprised of a member having an elongated arm having first and second ends, said first end secured to said second end of said cleaning device, said second end pivotally secured to said second end of said developing device housing.

7. Apparatus as set forth in claim 6 wherein said corona discharge means is releasably carried by said second housing.

8. A process kit for insertion and use in an image-forming apparatus comprising:

a housing;

a photosensitive drum rotatably mounted in said housing;

processing means including a plurality of components mounted in said housing in spaced relation around said photosensitive drum, said components including at least a corona discharge means for uniformly charging said photosensitive drum to a predetermined potential and development means for developing an electrostatic latent image formed on the photosensitive drum, and a cleaning device for cleaning said photosensitive drum subsequent to formation of said electrostatic latent image thereon, said cleaning deviced being in peripheral spaced relation around said photosensitive drum from said development means;

said housing having a pair of opposite ends, said housing including a first optical opening located upstream of said corona discharge means for conducting a uniform light to said photosensitive drum to discharge the remaining charge on said photosensitive drum and a second opening for exposure located between said corona discharge means and said development means for conducting said information light to said photosensitive drum, a third opening disposed at a position generally opposite said first and second openings, said first, second, and third openings disposed longitudinally between said opposite ends of said housing; and removable cover means removably carried by said housing for enclosing said first, second, and third openings prior to insertion of said process kit in said image forming apparatus, said removable cover means being a flexible unitary member disposed for complete removal from said first, second, and third opening for unobstructed relation of said first, second, and third openings in said image forming apparatus subsequent to insertion of said process kit in said image forming apparatus, said removable cover means being discontinuous and having opposite ends thereon, and securing means disposed at said opposite ends of said removable cover means for secured relation of said removable cover means around said opposite ends of said housing.

9. Apparatus as set forth in claim 8 wherein said securing means are Velcro TM strips disposed at said ends of said removable cover member.

10. Apparatus as set forth in claim 8 wherein said securing means includes eyelets disposed at one of said ends of said removable cover member and hooks disposed at the second of said ends of said removable cover member.

* * * * *